US007186089B2

(12) United States Patent
Liang

(10) Patent No.: US 7,186,089 B2
(45) Date of Patent: Mar. 6, 2007

(54) COOLING SYSTEM FOR A PLATFORM OF A TURBINE BLADE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 53 days.

(21) Appl. No.: 10/981,290

(22) Filed: Nov. 4, 2004

(65) Prior Publication Data

US 2006/0093484 A1 May 4, 2006

(51) Int. Cl.
*F01D 5/30* (2006.01)

(52) U.S. Cl. ..... 416/193 A

(58) Field of Classification Search ..... 416/193 A, 416/96 A, 96 R, 97 R; 415/115
See application file for complete search history.

(56) References Cited

U.S. PATENT DOCUMENTS

| | | | | |
|---|---|---|---|---|
| 4,017,210 | A | 4/1977 | Darrow | |
| 4,019,832 | A | 4/1977 | Salemme et al. | |
| 5,244,345 | A * | 9/1993 | Curtis | 416/95 |
| 5,482,435 | A | 1/1996 | Dorris et al. | |
| 6,082,961 | A | 7/2000 | Anderson et al. | |
| 6,120,249 | A | 9/2000 | Hultgren et al. | |
| 6,158,962 | A | 12/2000 | Lee et al. | |
| 6,254,333 | B1 | 7/2001 | Merry | |
| 6,341,939 | B1 | 1/2002 | Lee | |
| 6,431,833 | B2 | 8/2002 | Jones | |
| 6,457,935 | B1 * | 10/2002 | Antunes et al. | 415/115 |
| 6,478,540 | B2 | 11/2002 | Abuaf et al. | |
| 6,641,360 | B2 | 11/2003 | Beeck et al. | |
| 2005/0111980 | A1 * | 5/2005 | Negulescu et al. | 416/97 R |

FOREIGN PATENT DOCUMENTS

| | | |
|---|---|---|
| EP | 0 801 208 A2 | 10/1997 |
| EP | 0 937 863 A2 | 8/1999 |
| JP | 11287104 A | 10/1999 |

* cited by examiner

*Primary Examiner*—Edward K. Look
*Assistant Examiner*—Nathan Wiehe

(57) ABSTRACT

A turbine blade for a turbine engine having a platform cooling system formed from one or more platform cooling channels extending from an inner cooling cavity in a root of a turbine blade to an outer surface of a platform on the turbine blade. The platform cooling channels may be positioned in ribs protruding from a bottom surface of the platform. The ribs act as fins during operation of a turbine engine in which the turbine blade is installed by increasing surface area of the platform and thereby increasing convection on the bottom surface.

13 Claims, 3 Drawing Sheets

COOLING SYSTEM FOR A PLATFORM OF A TURBINE BLADE

FIELD OF THE INVENTION

This invention is directed generally to turbine blades, and more particularly to hollow turbine blades having internal cooling channels for passing cooling fluids, such as air, through the cooling channels to cool the blade platform.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion and a platform at one end and an elongated portion forming a blade that extends outwardly from the platform. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Conventional turbine blades often include a plurality of channels in the platform of a turbine blade to remove heat. As shown in FIGS. 1 and 2, some conventional platform cooling systems included film cooling orifices in the platform. During operation, the pressure of the cooling system in the turbine blade dead rim cavity is higher than the pressure on the external side of the turbine blade, which induces high leakage flow around the turbine blade attachment region and thus causes inefficient operation. Another conventional turbine blade platform cooling system, as shown in FIGS. 3 and 4, is formed from cooling channels having a high length to diameter ratio with cooling channels positioned generally parallel to an exterior surface of the turbine blade. This configuration produces unacceptably high stress levels in the platform and thus, yields a short blade useage life, which is due primarily to the large mass of turbine blade material at the front and back of the blade attachment and due to the transverse orientation of the cooling channels relative to the primary stress field. Thus, a need exists for an improved platform cooling system enabling a turbine engine to operate more efficiently.

SUMMARY OF THE INVENTION

This invention relates to a turbine blade cooling system of a turbine engine, and more specifically, to a platform cooling system of a turbine blade. The platform cooling system is positioned in a platform of a turbine blade for reducing the temperature of the platform during operation of a turbine engine in which the turbine blade is mounted. The turbine blade may be formed from a generally elongated blade having a leading edge, a trailing edge, a tip, a root coupled to the blade at an end generally opposite the first end for supporting the blade and for coupling the blade to a disc, at least one cavity forming a cooling system in the turbine blade, at least one outer wall defining the cavity forming the cooling system, and a platform generally orthogonal to the generally elongated blade and proximate to the root.

The platform cooling system may be formed from one or more ribs protruding from a bottom surface of the platform. One or more of the ribs may include a platform cooling channel providing a pathway from the cooling cavity forming the cooling system in the turbine blade to an outer surface of the platform. The ribs may be positioned on an outer surface of the platform on a side of the platform extending proximate to a pressure side or a suction side of the generally elongated blade, or on both sides of the turbine blade. The ribs may be positioned generally parallel to each other or in other appropriate positions. The ribs may also taper from a smaller cross-sectional area at an end proximate a side surface of the platform to a larger cross-sectional area at the root.

During operation, cooling fluids, such as, but not limited to, air, may be passed through the cooling system and through the platform cooling channels. The cooling fluids pass through the platform cooling channels and increase in temperature as heat is transferred from the root of the turbine blade to the cooling fluids. The cooling fluids may be discharged from the turbine blade by passing out of the platform cooling channels and onto outer surfaces of the platform. In at least one embodiment, the cooling fluids may impinge on adjacent turbine components after being discharged from the platform cooling channels.

An advantage of this invention is that the ribs protruding from a bottom surface of the platform act as fins by increasing the surface area upon which convection can occur, thereby increasing the cooling capacity of the internal cooling system of the turbine blade.

Another advantage of this invention is that the configuration of the platform cooling system reduces stress and as a result, reduces the likelihood of cracking of the turbine blade.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
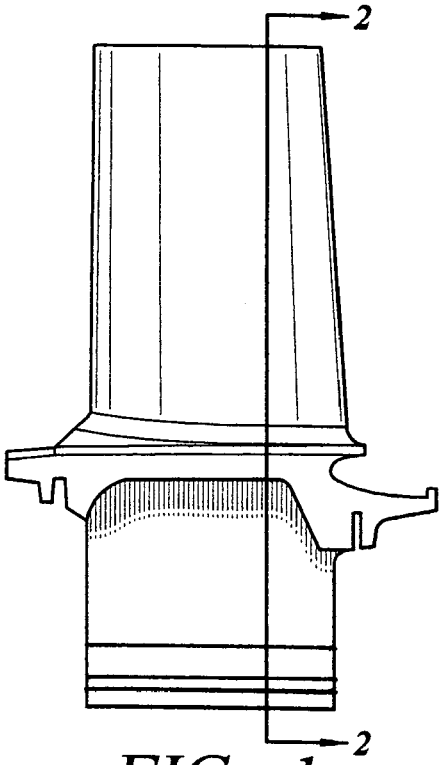
FIG. 1 (PRIOR ART)
FIG. 1 is a side view of a conventional turbine blade.
Figure 2:
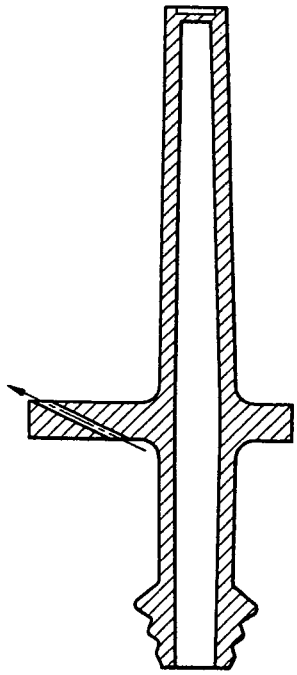
FIG. 2 (PRIOR ART)
FIG. 2 is a cross-sectional view of the turbine blade of FIG. 1 taken along section line 2—2 in FIG. 1.
Figure 3:
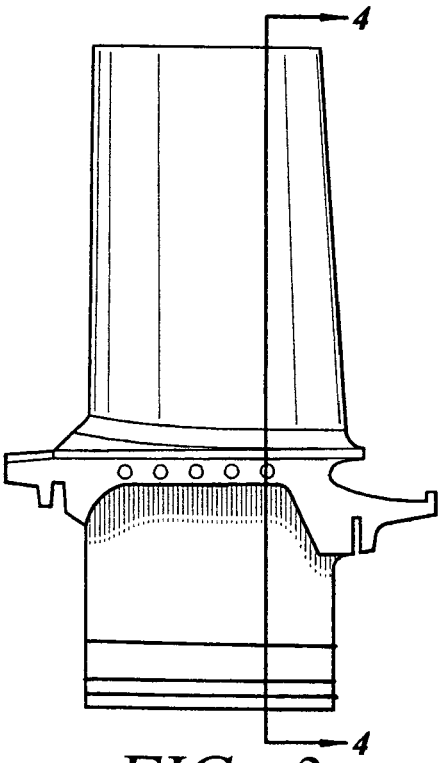
FIG. 3 (PRIOR ART)
FIG. 3 is a side view of another conventional turbine blade.
Figure 4:
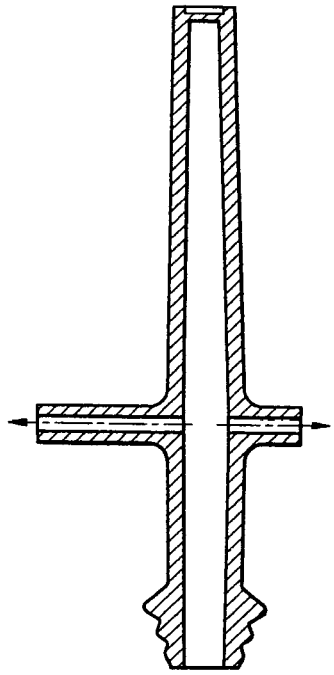
FIG. 4 (PRIOR ART)
FIG. 4 is a cross-sectional view of the turbine blade of FIG. 3 taken along section line 4—4 in FIG. 3.

This invention is directed to a turbine blade cooling system 10 for turbine blades 12 used in turbine engines, as shown in FIGS. 5–8. In particular, turbine blade cooling system 10 is directed to a platform cooling system 10 located in a platform 18, as shown in FIGS. 5–8, extending between a cooling cavity 14 and an outer surface 19 of the platform 18 for removing heat from the platform during operation of a turbine engine in which the turbine blade 12 is positioned.

Figure 5:
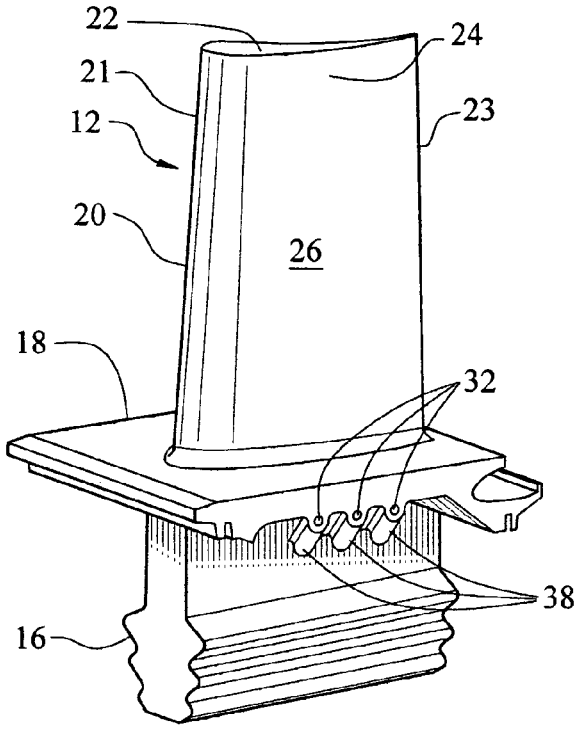
FIG. 5 is a perspective view of a turbine blade containing a cooling system of this invention.
Figure 7:
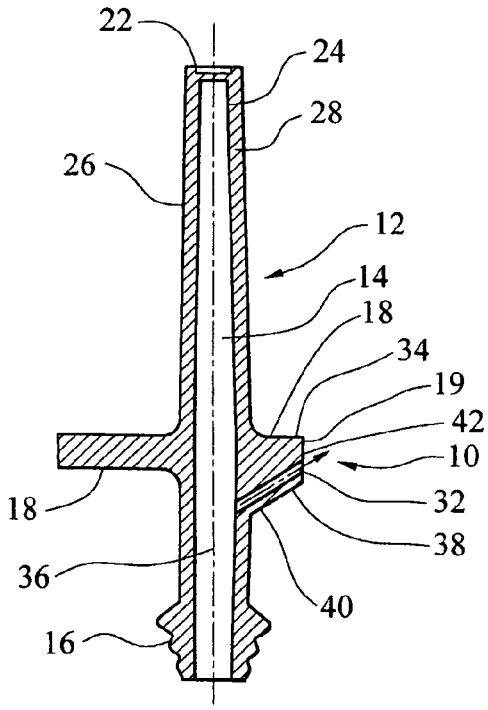
FIG. 7 is a cross-sectional view of the turbine blade of FIG. 5 showing aspects of this invention taken along section line 7—7 in FIG. 6.
Figure 8:
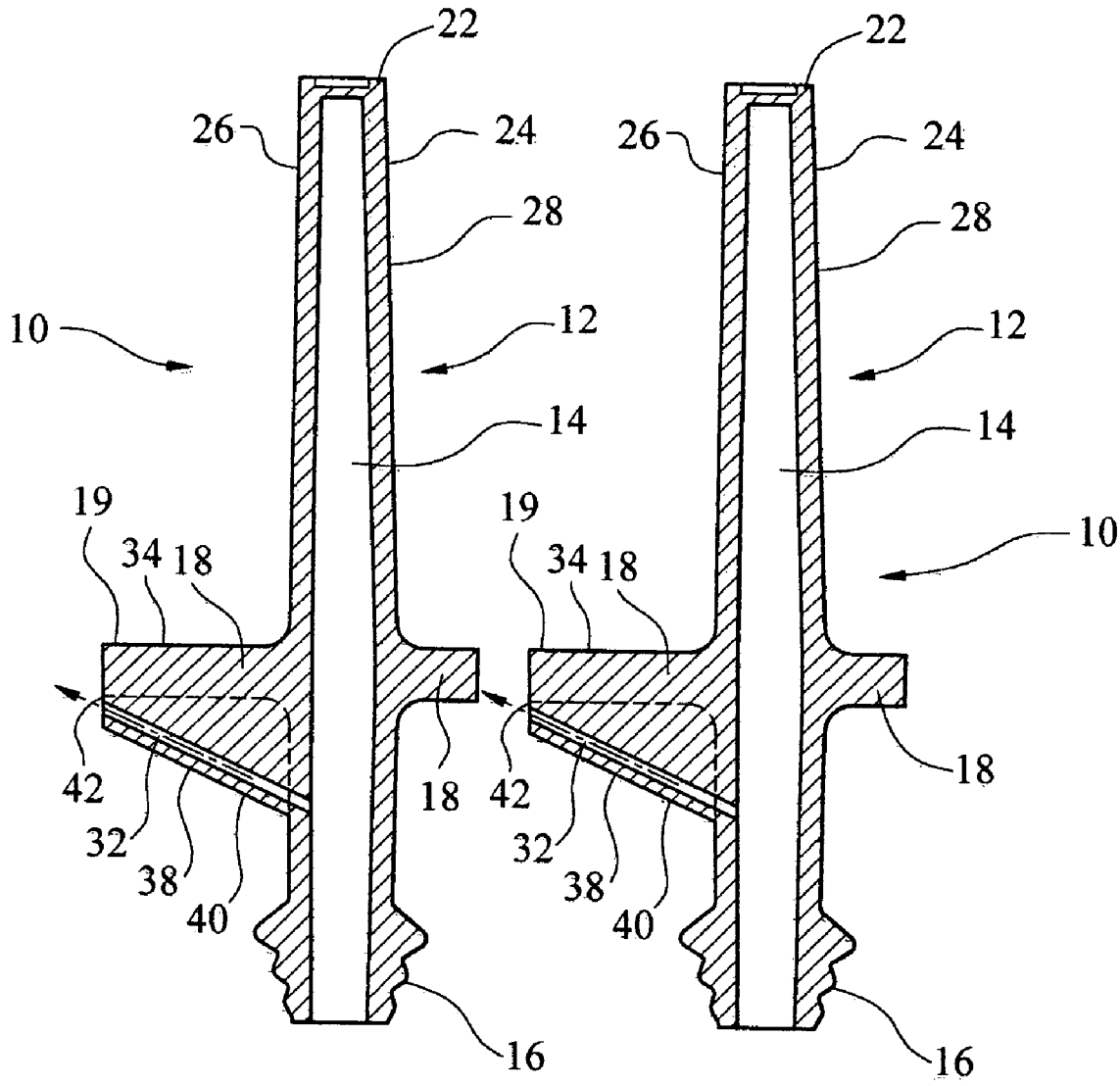
FIG. 8 is a cross-sectional view of an alternative platform cooling system turbine blade of FIG. 5 showing aspects of this invention taken along section line 7—7 in FIG. 6.

As shown in FIG. 5, the turbine blade 12 may be formed from a root 16 having a platform 18 and a generally elongated blade 20 coupled to the root 16 at the platform 18. The turbine blade 12 may have a leading edge 21 and a trailing edge 23. The turbine blade 12 may also include a tip 22 at an end of the elongated blade 20 generally opposite the root 16 and the platform 18. The elongated blade 20 may be formed from an outer wall 24 adapted for use in a turbine engine 12, for example, in a first stage of an axial flow turbine engine or other stage. Outer wall 24 may have a generally concave shaped portion forming pressure side 26 and may have a generally convex shaped portion forming suction side 28. The cavity 14, as shown in FIGS. 7 and 8, may be positioned in inner aspects of the blade 20 for directing one or more gases, which may include air received from a compressor (not shown), through the blade 20. The cavity 14 is not limited to a particular shape, size, or configuration. Rather, the cavity 14 may have any appropriate configuration.

Figure 6:
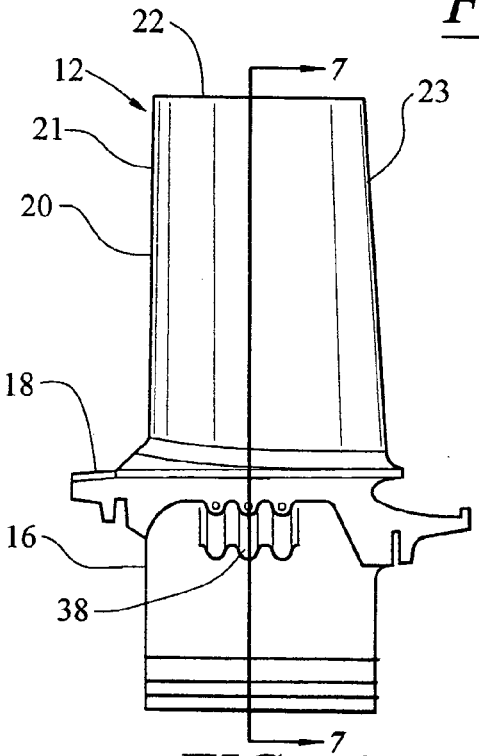
FIG. 6 is a side view of the turbine blade of FIG. 5.

The platform cooling system 10 may be formed from one or more platform cooling channels 32 extending from the cooling cavity 14 to an outer surface 19 of the platform 18, as shown in FIGS. 7 and 8. The cooling channel 32 may be positioned relative to an upper outer surface 34 of the platform 18 such that the cooling channel is nonparallel to the upper outer surface 34 and nonparallel to a longitudinal axis 36 of the elongated blade 20. The cooling channel 32 may be sized according to the internal pressure in the cooling cavity 14 and other factors. In at least one embodiment, as shown in FIG. 6, the cooling channel 32 may be formed from a plurality of cooling channels 32 that may or may not be aligned generally parallel to each other.

The platform cooling system 10 may also include one or more ribs 38 protruding from a bottom surface 40 of the platform 18. The rib 38 may extend from a side surface 42 of the platform 18 to the root 16. In at least one embodiment, the rib 38 may taper from a cross-sectional area at the side surface 42 that is less than a cross-sectional area of the rib 38 at an intersection between the root 16 and the rib 38. In other embodiments, the rib 38 may have other appropriate shapes. The ribs 38 may be positioned on the platform 18 only on a single side of the root 16, for instance, on the suction side 28, as shown in FIG. 7, or on the pressure side 26 as shown in FIG. 8. In another embodiment, the ribs 38 may be positioned on both sides of the root 16. The rib 38 may include a single platform cooling channel 32 within the rib 38 or a plurality of platform cooling channels 32 within the rib 38. The platform cooling channel 32 may extend generally along a longitudinal axis of the rib 38. In embodiments having a plurality of ribs 38, the platform cooling system 10 may include a platform cooling channel 32 in each rib 38 or a platform cooling channel 32 in less than all of the ribs 38. In addition, the plurality of ribs 32 may be positioned parallel to each other on the bottom surface 40 of the platform 18. The platform cooling channels 32 may be positioned in close proximity to the bottom surface 40 of the rib 38, as shown in FIGS. 7 and 8. In other words, the platform cooling channels 32 may be placed closer to the bottom surface 40 than to the upper outer surface 34 of the platform 18.

During operation, cooling fluids, such as, but not limited to, air, are passed through the platform cooling system 10. Cooling fluids are injected into cooling cavity 14 and flow through internal aspects of the turbine blade 12. At least a portion of the cooling fluids are passed into the platform cooling channels 32. The cooling fluids contact the inner surfaces forming the platform cooling channels 32 and increase in temperature as heat moves from the platform 18 to the cooling fluids. The cooling fluids flow from the platform cooling channels 32 to outer surface 19 of the platform 18. In at least one embodiment, the cooling fluids exit from the side surface 42 of the platform 18 and impinge on a platform of an adjacent turbine component, as shown in FIG. 8. In at least one embodiment, the adjacent turbine component may be a platform.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end;

a root coupled to the blade at an end generally opposite the first end for supporting the blade and for coupling the blade to a disc;

at least one cavity forming a cooling system in the turbine blade;

at least one outer wall defining the at least one cavity forming the cooling system;

a platform generally orthogonal to the generally elongated blade and proximate to the root;

at least one rib protruding from a bottom surface of the platform, extending at an oblique angle to the platform contacting the root; and at least one platform cooling channel in the at least one rib providing a pathway from the at least one cavity forming a cooling system in the root of the turbine blade to an outer side surface of the platform, wherein the at least one platform cooling channel terminates at the outer side surface of the platform to provide impingement cooling to a platform side surface on a platform of an adjacent turbine blade.

2. The turbine blade of claim 1, wherein the at least one rib is positioned on an outer surface of the platform on a side of the platform extending proximate to a pressure side of the generally elongated blade.

3. The turbine blade of claim 1, wherein the at least one rib is positioned on an outer surface of the platform on a side of the platform extending proximate to a suction side of the generally elongated blade.

4. The turbine blade of claim 1, wherein the at least one platform cooling channel is positioned nonparallel relative to an outer surface of the platform and nonparallel relative to a longitudinal axis of the generally elongated blade.

5. The turbine blade of claim 1, wherein the at least one rib comprises a plurality of ribs protruding from the bottom surface of the platform in a generally parallel configuration.

6. The turbine blade of claim 5, wherein the plurality of ribs extend along the bottom surface of the platform only on a single side of the root.

7. The turbine blade of claim 1, wherein the at least one rib protruding from the bottom surface of the platform tapers from a first thickness at a tip of the rib to a second thickness at an intersection between the at least one rib and the root, wherein the second thickness proximate the root is larger than the first thickness.

8. A turbine blade, comprising:

a generally elongated blade having a leading edge, a trailing edge, and a tip at a first end;

a root coupled to the blade at an end generally opposite the first end for supporting the blade and for coupling the blade to a disc;

at least one cavity forming a cooling system in the turbine blade;

at least one outer wall defining the at least one cavity forming the cooling system;

a platform generally orthogonal to the generally elongated blade and proximate to the root;

at least one rib protruding from a bottom surface of the platform, extending at an oblique angle to the platform and contacting the root; and at least one platform cooling channel in the at least one rib providing a pathway from the at least one cavity forming a cooling system in the root of the turbine blade to an outer side surface of the platform, wherein the at least one platform cooling channel terminates at the outer side surface of the platform to a provide impingement cooling to platform side surface on a platform of an adjacent turbine blade;

wherein the at least one platform cooling channel is positioned nonparallel relative to an outer surface of the platform and nonparallel relative to a longitudinal axis of the generally elongated blade.

9. The turbine blade of claim 8, wherein the at least one rib is positioned on an outer surface of the platform on a side of the platform extending proximate to a pressure side of the generally elongated blade.

10. The turbine blade of claim 8, wherein the at least one rib is positioned on an outer surface of the platform on a side of the platform extending proximate to a suction side of the generally elongated blade.

11. The turbine blade of claim 8, wherein the at least one rib comprises a plurality of ribs protruding from the bottom surface of the platform in a generally parallel configuration.

12. The turbine blade of claim 11, wherein the plurality of ribs extend along the bottom surface of the platform only on a single side of the root.

13. The turbine blade of claim 8, wherein the at least one rib protruding from the bottom surface of the platform tapers from a first thickness at a rip of the rib to a second thickness at an intersection between the at least one rib and the root, wherein the second thickness proximate the root is larger than the first thickness.

* * * * *